United States Patent [19]

Knox

[11] Patent Number: 4,838,198

[45] Date of Patent: Jun. 13, 1989

[54] BOOK MARK

[76] Inventor: Darryl T. Knox, 47650 Burton, Utica, Mich. 48067

[21] Appl. No.: 184,005

[22] Filed: Apr. 20, 1988

[51] Int. Cl.[4] ..... B42D 9/00

[52] U.S. Cl. ..... 116/239; 281/42; 116/234

[58] Field of Search ..... D19/34; 116/234, 236–239; 281/42; 24/306; 40/658, 908; 2/DIG. 16

[56] References Cited

U.S. PATENT DOCUMENTS

| | | | |
|---|---|---|---|
| D. 111,781 | 10/1938 | Brennan | D19/34 |
| D. 144,564 | 4/1946 | Heil | D19/34 |
| D. 167,016 | 6/1952 | Zaccone | D19/34 |
| D. 184,628 | 3/1959 | Lazarus | D19/34 |
| D. 235,174 | 5/1975 | Gardner | D3/18 |
| 1,710,062 | 4/1929 | Moore | 116/238 |
| 1,816,910 | 8/1931 | Moore | 281/42 |
| 1,847,184 | 3/1932 | Hellerman | 116/239 |
| 2,543,182 | 2/1951 | Lang | 116/239 |
| 2,591,094 | 4/1952 | O'Neill | 281/42 |
| 3,128,514 | 4/1964 | Parker et al. | 24/306 |
| 3,143,998 | 8/1964 | Madden | 116/238 |
| 3,425,389 | 2/1969 | Sacco et al. | 116/236 |
| 3,895,797 | 7/1975 | Moore | 273/32 A |
| 3,898,951 | 8/1975 | Clare | 116/239 |
| 4,236,479 | 12/1980 | Walker et al. | 116/28. R |

FOREIGN PATENT DOCUMENTS

| | | | |
|---|---|---|---|
| 24930 | of 1909 | United Kingdom | 116/238 |
| 495142 | 11/1938 | United Kingdom | 116/237 |

*Primary Examiner*—William A. Cuchlinski, Jr.
*Assistant Examiner*—W. Morris Worth
*Attorney, Agent, or Firm*—Basile and Hanlon

[57] ABSTRACT

A book mark releasably mountable on a book. The book mark includes a book page indicator member and a clip which is detachably mountable over an edge of a book, such as an edge of a book cover. The book page indicator member is releasably attachable to the clip by, preferably, a two-part mating fabric pile and loop fastener, one part being mounted on the book page indicator member and the other part being mounted on a clip. A flexible connector may be provided extending between and coupling the book page indicator member to the clip.

6 Claims, 1 Drawing Sheet

BOOK MARK

BACKGROUND OF THE INVENTION

1. Field of the Invention:

The present invention relates, in general, to book marks and, more specifically, to book marks which are releasably attachable to a book.

2. Description of the Prior Art:

Book marks are commonly used to mark a page location in a book where the reader has stopped reading. Typically, book marks are in the form of a thin, planar member which is insertable between the pages of a book and can be removed from the book when the user desires to read the book.

However, since most book marks are not attached to the book itself in some manner, there is a frequent tendency for the book mark to be lost or misplaced after it has been removed from the book so that it cannot be easily found when the reader ceases reading and desires to mark his location in the book.

To overcome this problem, book marks have been devised which include a clip which is permanently or detachably attached to the book. Such clips have been attached to or inserted in the spine of the book cover and carry a ribbon or thin cord to mark a page in the book. While obviating the possibility of losing the book mark during reading, such attachable book marks have utilized complicated and therefore costly attachment means or clips which results in an increased manufacturing cost. Also, certain of these book marks are usable only with books in which the side pages are bound together themselves separate from the spine connecting the front and back covers of the book. As such, these book marks cannot be used on books in which the side edges of the pages are themselves secured directly to the spine and therefore lack a space between the spine and the side edges of the pages.

Thus, it would be desirable to provide a book mark which is removably attachable to a book to prevent loss of the book mark when the book is being read. It would also be desirable to provide a removably attachable book mark which is inexpensive in cost and, further, is easy to use. Finally, it would also be desirable to provide a removably attachable book mark which is usable with all types of books, regardless of their construction.

SUMMARY OF THE INVENTION

The present invention is a book mark which is releasably attachable to a book. The book mark includes a book page indicator member and a clip which is detachably securable over an edge of a book. The book mark also includes means for releasably attaching the book page indicator member to the clip when the book page member is not in use to indicate a page location within the book.

In a preferred embodiment, the attaching means comprises a two part, releasably matable, fabric pile and hook fastener, with one part being mounted on the clip and the other part being mounted on the book page indicator member. In this manner, when the clip is attached to an edge of the book, such as over the top edge of the back cover of the book, the book page indicator member, when removed from the book, may be attached to the clip thereby retaining the book mark directly on the book to facilitate its re-use when the user has ceased reading the book.

The book mark of the present invention may also include a flexible connector for permanently connecting the book page indicator member to the clip to further prevent any possibility of loss of the book mark. In this embodiment, the flexible connector comprises a string extending between the clip and the book page indicator member.

The book mark of the present invention is releasably attachable to an edge of a book, such as the edge of a book cover, to prevent loss or misplacement of the book mark after it has been removed from the pages of the book. The clip and detachable fastener means employed to releasably attach the book mark to a book and to releasably attach the book page indicator member to the clip are adapted for use with all types of books, regardless of their construction, thereby enhancing the widespread use of the book mark of the present invention. Finally, the present book mark is easy to use and has a low manufacturing cost due to the simplified fastening and attachment means employed in the book mark.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
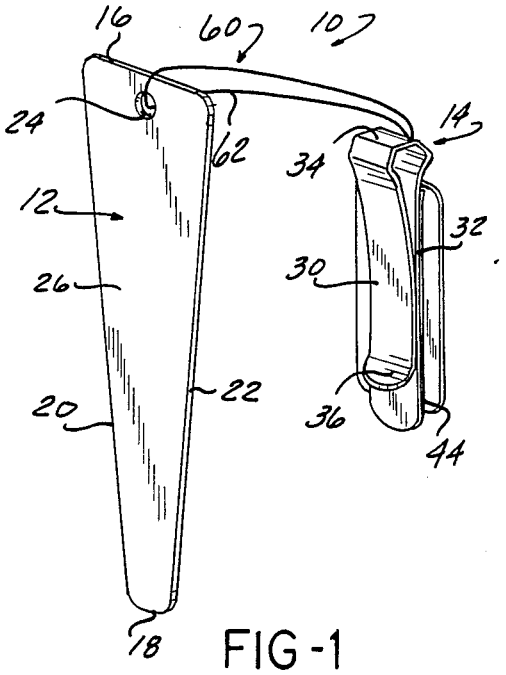
FIG. 1 is a perspective view of the book mark of the present invention.

Throughout the following description and drawing, an identical reference number is used to refer to the same component shown in multiple figures of the drawing.

Referring now to the drawing, and to FIG. 1 in particular, there is illustrated a book mark 10 which is releasably attachable to a book. The book mark 10 serves to indicate a page location within the book and yet prevents loss or misplacement of the book mark 10 while the book is being read.

Figure 2:
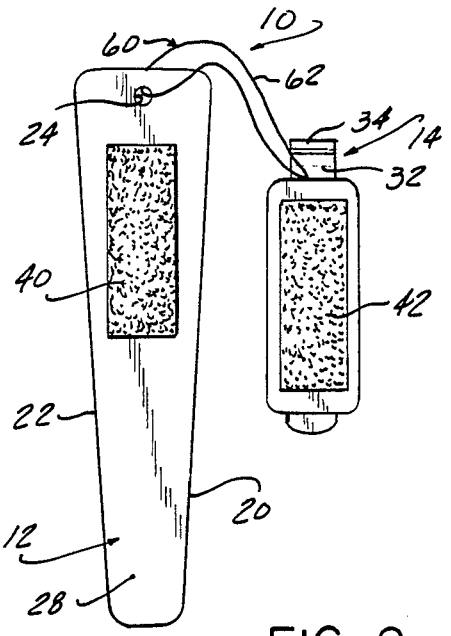
FIG. 2 is a rear elevational view of the book page indicator member and the clip of the book mark shown in FIG. 1.
Figure 3:
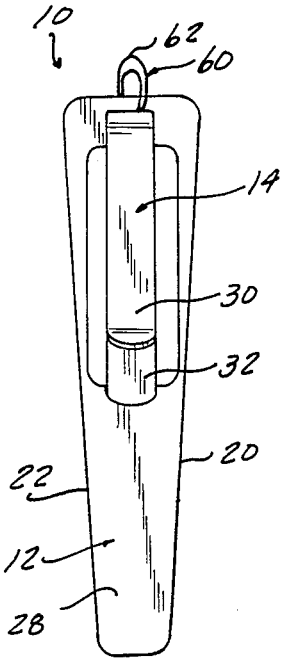
FIG. 3 is a rear view showing the book page indicator member attached to the clip.

As shown in FIGS. 1, 2 and 3, the book mark 10 includes a book page indicator member 12 and a clip 14.

The book page indicator member 12 may have any shape so as to easily fit between pages of a book to indicate a page location within the book. In general, the book page indicator member 12 has an elongated, thin, planar form. It will be understood that any shape or size book page indicator member 12 may be employed in the book mark 10 of the present invention.

As shown in FIGS. 1, 2 and 3, in a preferred embodiment, the book page indicator member 12 is provided with a top end 16 a bottom end 18 and opposed side walls 20 and 22 giving it a substantially elongated, rectangular form. The opposed side walls 20 and 22 taper slightly inward from the top end 16 to the smaller bottom end 18.

The book page indicator member 12 may be formed of any material, such as plastic, metal, paper, wood, etc. In a preferred embodiment, the book page indicator member 12 of the present invention is formed of plastic for a low manufacturing cost and long useability. The use of plastic also enables the book page indicator member 12 to be formed in any desired color and, also, be imprinted with any type of indicia, such as words, symbols, designs, etc.

As shown in FIGS. 1 and 2, the book page indicator member 12 also includes an aperture 24 located adjacent the top end 16. Finally, the book page indicator member 12 due to its thin elongated shape is formed with opposed major surfaces 26 and 28.

The clip 14 is designed to be detachably securable over an edge of the book, such as the edge of the back cover of the book, as described hereafter. The clip 14 may be formed of any suitable material, although metal is utilized in a preferred embodiment of the present invention for its low manufacturing cost and ease in providing the clip with spring or resilient properties.

As shown in FIG. 1, the clip 14 has a generally U-shaped configuration formed of first and second legs 30 and 32, respectively which are joined together by an integral, central bite portion 34. The first leg 30 is slightly shorter than the second leg 32 and has an outwardly flared end portion 36 formed adjacent its bottom end for ease of attachment over an edge of the book.

The central bite portion 34 connects the first and second legs 30 and 32 together and is outwardly bulged adjacent one end of the first and second legs 30 and 32 to accommodate varying widths of material over which the clip 14 is mounted. Due to the resilient characteristics of the spring steel used in a preferred embodiment of the present invention to form the clip 14, the first and second legs 30 and 32 may be urged apart as the clip 14 is inserted over an edge of the book to securely and yet releasably attach the clip 14 to a book.

The book mark 10 of the present invention also includes means for releasably attaching the book page indicator member 12 to the clip 14 when the book page indicator member 12 is not used to indicate a page location within the book.

In a preferred embodiment, the attaching means is formed of two part, detachably interconnectible, fabric portions 40 and 42, one of knit loop and one of hook pile, such as that sold commercially under the trademark VELCRO. One of the portions of the fastening means is attached to the book page indicator member 12 and the other attached to the clip 14. As shown in FIGS. 2 and 3, one of the fastener portions 40 is attached to one of the major surfaces of the book page indicator member 12, such as major surface 28. The other fastener portion 42 is attached to one leg, such as leg 32, of the clip 14. Such attachment of the fastener portions 40 and 42 to the respective book page indicator member 12 and the clip 14 may be by any suitable means, such as the use of adhesive as shown by reference number 44 in FIG. 4.

It will be clearly understood that the above-described two part detachably interconnectible fabric loop and pile fastener is described and depicted by way of example only as other fastening means may also be employed to detachably attach the book page indicator member 12 to the clip 14. Thus, by way of example only and not limitation, the attaching means may comprise a magnet mounted on the book page indicator member 12 which is releasably attachable to the metallic clip 14, or detachable, interconnectable connectors, such as conventional snaps, may be mounted on the book page indicator member 12 and the clip 14.

Figure 4:
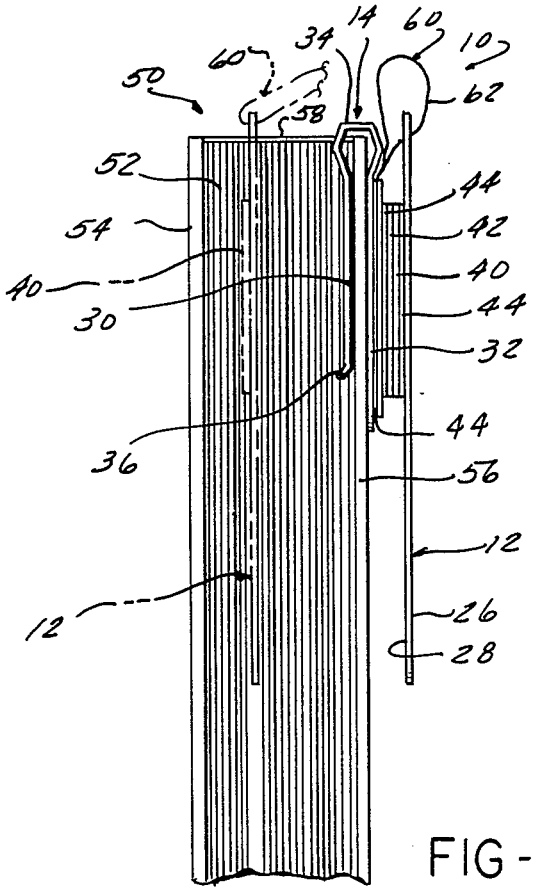
FIG. 4 is a side elevational view showing the removable attachment of the book mark of the present invention on a book.

Referring briefly to FIG. 4, the advantageous use of the book mark 10 of the present invention will now be described. As shown in FIG. 4 in solid lines, the clip 14 is implaced over an edge of a book denoted in general by reference number 50. The book 50 may be of conventional construction and includes a plurality of pages 52 contained between a front cover 54 and a rear cover 56 joined by a central spine portion 58. The clip 14 is inserted over the top edge of the back cover 56 of the book 50 with the first leg 30 of the clip 14 disposed interiorally between the cover 56 and the pages 52 of the book 50 and the second leg 32 located exteriorly of the book cover 56. In this orientation, the fastening portion 42 attached to the clip 14 faces outward from the book 50.

In this manner, the mating fastening portion 40 attached to the book page indicator member 12 may be attached to the clip 14 and held in place for convenient retrieval when the user of the book desires to mark a page location within the book.

In order to mark a page location within the book, the user need only detach the book page indicator member 12 from the clip 14 and insert it at the appropriate page location within the book 50.

The book mark 10 of the present invention may also include connector means denoted by reference number 60 for flexibly yet permanently connecting the clip 14 to the book page indicator member 12. In a preferred embodiment, the connector means 60 includes an elongated, flexible string 62 which is looped through the aperture 24 in the book page indicator member 12 and has its ends attached to the clip 14, such as by use of the adhesive 44 utilized to secure the fastening portion 42 to the clip 14. The connector means 60 functions to permanently retain the book page indicator member 12 in association with the clip 14 and prevents it from being lost or misplaced when not in use to mark a page within a book.

String 62 has been described as forming the connector means 60 of the present invention. It will, however, be understood that other connector means exhibiting flexible characteristics, such as a plastic cord, metal chain, etc., may also be employed in the present invention.

In summary, there has been disclosed a unique book mark which enables the book mark to be securely retained on a book thereby preventing its loss or misplacement. The book mark of the present invention is attachable to any edge of a book in an easy and convenient manner.

What is claimed is:

1. A book mark comprising:

an elongated planar book page indicator member;

a clip separate from the book page indicator member and detachably securable over an edge of a book; separate connector means flexibly connecting the clip and the book page indicator member together and means for separably attaching the book page indicator member to the clip when the book page indicator member is not in use to locate a page in a book.

2. The book mark of claim 1 wherein the attaching means comprises:

a two-part, releasably matable fabric pile and hook fastener, one part being mounted on the clip and the other part being mounted on the book page indicator member.

3. The book mark of claim 1 wherein the connector means comprises:

a flexible string extending between and joining the clip and the book page indicator member.

4. The book mark of claim 1 wherein the clip is formed of two separable legs joined at one end by a central bite portion.

5. The book mark of claim 4 wherein the clip is formed of a spring metal.

6. A book mark comprising:

an elongated, planar book page indicator member;

a clip separate from the book page indicator member and detachably securable over an edge of a book;

means for releasably attaching the book page indicator member to the clip, the attaching means including a two-part releasably matable fabric pile and hook fastener, one part being mounted on the book page indicator member and the other part being mounted on the clip; and a separate flexible connector joining the book page indicator member and the clip together.

* * * * *